United States Patent [19]

Ogino et al.

[11] 4,456,807

[45] Jun. 26, 1984

[54] INDUCTION HEATING COOKING APPLIANCE

[75] Inventors: Yoshio Ogino, Nishinomiya; Takao Kobayashi, Hirakata; Yuji Tsuda, Hirakata; Hitoshi Nishimura, Hirakata, all of Japan

[73] Assignee: Matsushita Electric Industrial Co., Ltd., Osaka, Japan

[21] Appl. No.: 422,973

[22] PCT Filed: Dec. 25, 1981

[86] PCT No.: PCT/JP81/00413

§ 371 Date: Sep. 9, 1982

§ 102(e) Date: Sep. 9, 1982

[87] PCT Pub. No.: WO82/02466

PCT Pub. Date: Jul. 22, 1982

[30] Foreign Application Priority Data

Jan. 13, 1981 [JP] Japan ..... 56-4810

[51] Int. Cl.[3] ..... H05B 5/04

[52] U.S. Cl. ..... 219/10.77; 219/10.49 R

[58] Field of Search ..... 219/10.77, 10.4; 340/640

[56] References Cited

U.S. PATENT DOCUMENTS

| | | | |
|---|---|---|---|
| 4,129,767 | 12/1978 | Amagami et al. | 219/10.49 R |
| 4,169,222 | 9/1979 | Tucker | 219/10.49 R |
| 4,191,188 | 3/1980 | Belt et al. | 219/10.77 |
| 4,206,336 | 6/1980 | Cunningham | 219/10.49 R |
| 4,319,109 | 3/1982 | Bowles | 219/10.49 R |

*Primary Examiner*—Roy N. Envall, Jr.
*Assistant Examiner*—M. Lateef
*Attorney, Agent, or Firm*—Wenderoth, Lind & Ponack

[57] ABSTRACT

An induction heating type cooking appliance is adapted to heat a pan by induction heating. An input unit includes touch control keys and has a timer function so that the power supply is turned on only when at least two keys are actuated properly within a given length of time. Alarms are operatively associated with the timer function so as to alert the operator automatically when the pan is shifted or the appliance is operated under a no-load condition. Such an induction heating type cooking appliance therefore enjoys a high degree of safety.

4 Claims, 7 Drawing Figures

INDUCTION HEATING COOKING APPLIANCE

BACKGROUND OF THE INVENTION

1. Field of the Invention

This invention relates to an induction heating type cooking appliance for heating a metallic pan and cooking food by induction heating and more particularly it relates to an induction heating type cooking appliance wherein keys are provided on an operational section for controlling the operation of the appliance and especially for preventing the appliance from operating except when the keys are actuated in a proper manner.

2. Description of the Prior Art

The induction heating type cooking appliance having a maximum temperature which does not as a rule rise above the temperature of a pan has been well accepted as a fireless cooking appliance which is excellent in its safety and cleanliness. However, since no naked fire nor a heated portion is visible, problems are in fact experienced in that the user may get a burn on touching hot metallic articles (for example, a knife and a fork) carelessly placed thereon. Moreover, because it is preferable that an operational section be flush with the heating surface from the standpoint of operability and resistance to water, induction heating type cooking appliances with membrane switches which are or touch switches manually operable from above are most desirable. Nevertheless, such appliances have the constant danger of a faulty operation when an object happens to fall onto any input key or an animal such as a pet touches the key. A prior art approach to avoiding such problems is that a secret number is so programmed that the operational section is locked or unlocked only when a plurality of the keys are actuated in a predetermined order. Inputting such a secret number whenever the appliance is to be used is troublesome, adds to the complexity of the appliance controller, and tends to detract from the reliability of the appliance itself.

SUMMARY OF THE INVENTION

Accordingly, it is an object of the present invention to provide an induction heating type cooking appliance having a touch responsive input device wherein a timer function is provided for the input device to thereby turn off the power supply unless any output setting key is actuated within a given period subsequent to the actuation of the input keys and not to turn on power supply unless the keys are actuated in a predetermined order.

Specific embodiments of the present invention will now be described by reference to the accompanying drawings.

DESCRIPTION OF THE PREFERRED EMBODIMENTS

Figure 1:
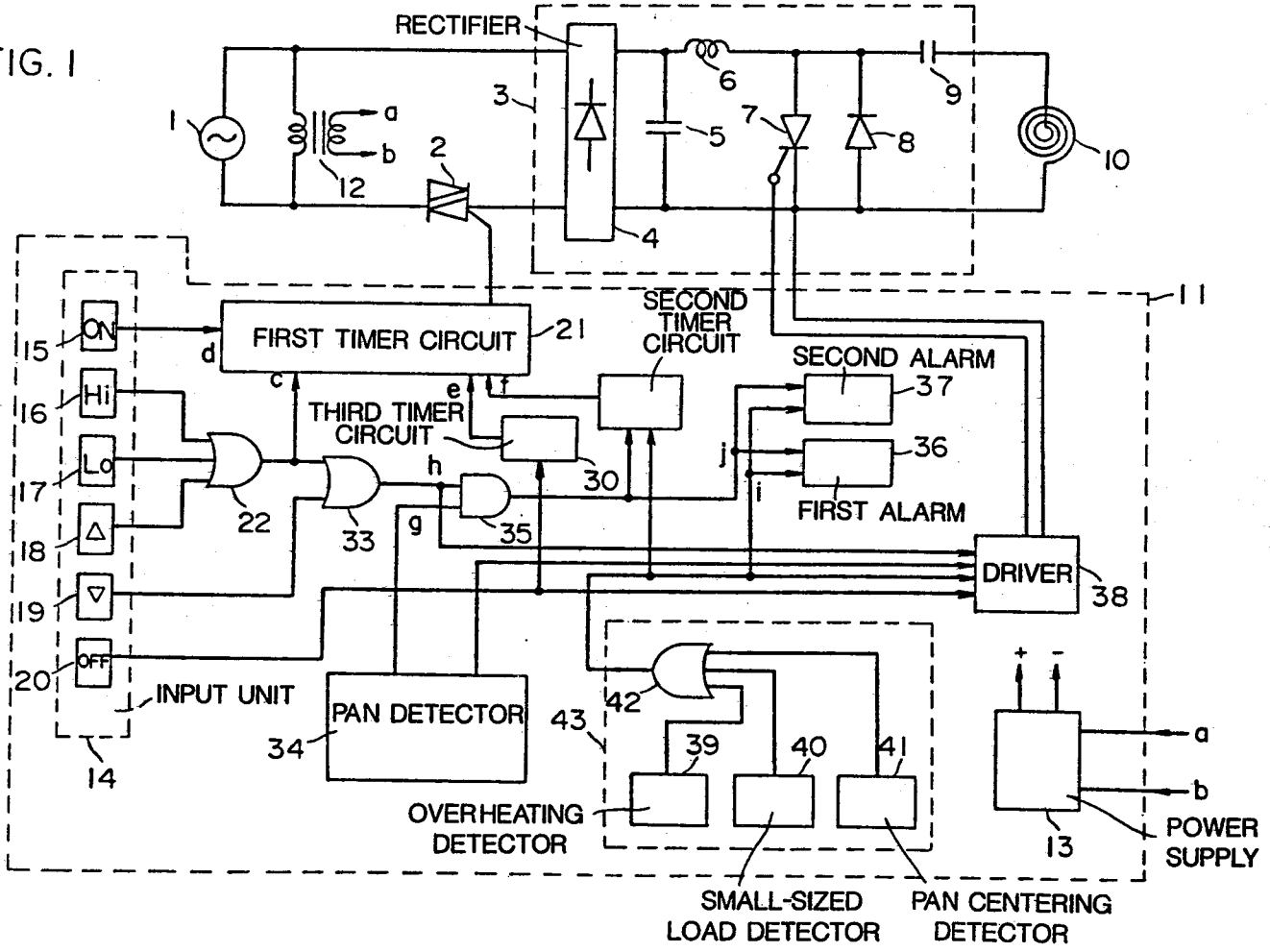
FIG. 1 is a circuit diagram of an induction heating type cooking appliance according to a preferred embodiment of the present invention.

Referring now to FIG. 1, a frequency converter 3 is connected via a power switch or a triac 2 to an AC power source 1, which converter 3 includes a rectifier 4 for full-wave rectifying the power source 1, a smoothing capacitor 5 for smoothing the resultant pulsating current, a thyristor 7 connected via a choke coil 6 to the resulting DC supply, a freewheel diode 8 reversely connected in parallel with the thyristor 7, and a commutation capacitor 9 connected in parallel with the thyristor and forming a series resonance circuit together with a heating coil 10 for ensuring commutation in the thyristor 7.

A control circuit 11 will now be described in terms of a touch control circuit. Because of the necessity of operating a logic circuit so as to activate the triac 2 when the triac 2 is in off position but when the control circuit 11 receives a turn-on input, a necessary source voltage is supplied from a power supply circuit 13 in the control circuit 11 after being descreased in voltage through a power transformer 12 whose primary winding is connected in parallel with a voltage source 1.

Figure 2:
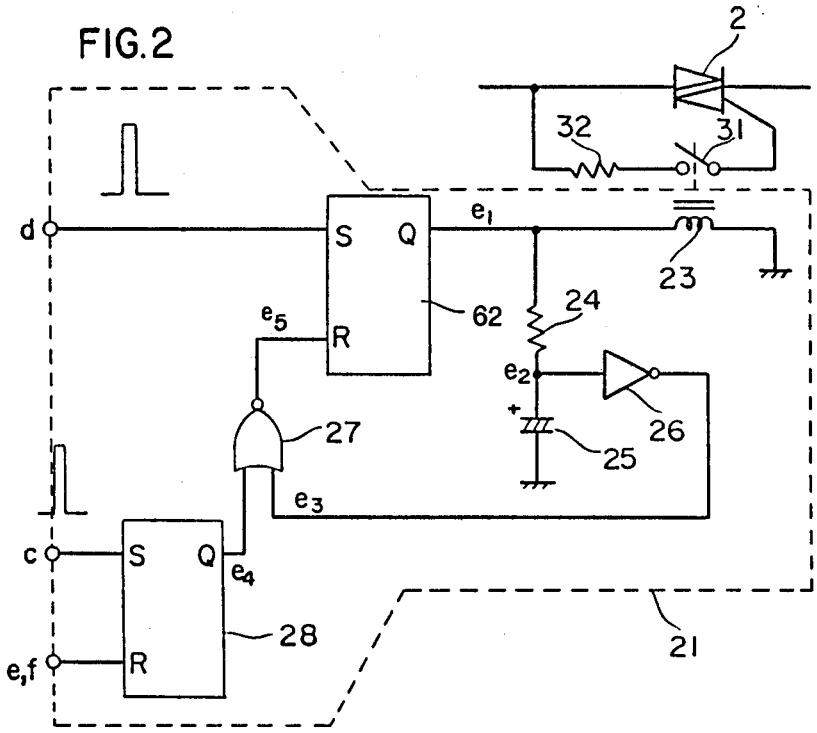
FIG. 2 is a circuit diagram of a first timer circuit in the same appliance.
Figure 3:
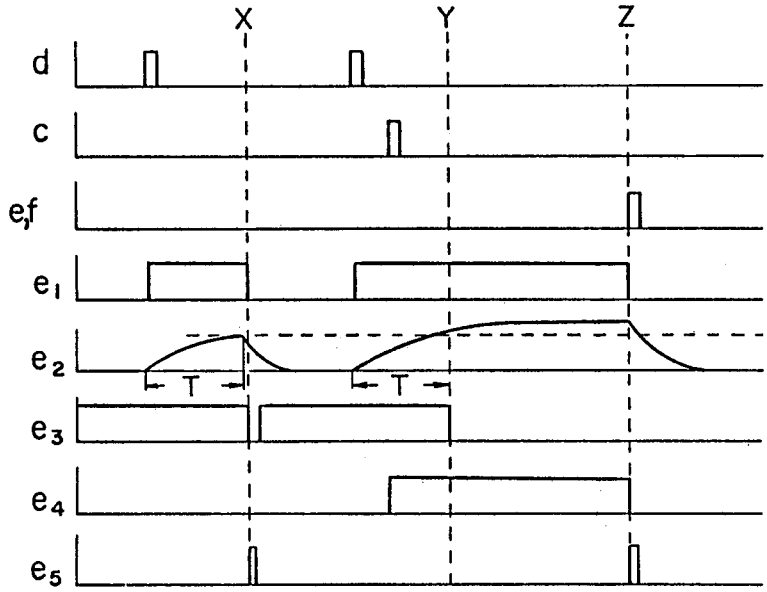
FIG. 3 is a view showing waveforms developing in the appliance; progress of operation of the first timer circuit in the appliance.

An input unit 14 includes a power turn-on key 15, a high output level setting key 16, a low output level setting key 17, an up key 18 for fine adjustment, a down key 19 for fine adjustment and a power off key 20. Of those keys, the respective keys 16, 17, 18 and 19 serve as output setting keys. When the power on input key 15 is touched, an output signal is fed to operate a first timer circuit 21 for a period of 5 to 10 seconds so that the triac 2 becomes conductive for a period of 5 to 10 seconds in response to the output of the first timer circuit 21. Since the frequency converter 3 is supplied with the source voltage, a high frequency current flows through the heating coil 10 as long as a gate signal is fed to the thyristor 7. If the high output setting key 16, the low output setting key 17 or the up key 18 is actuated within such a period of 5 to 10 seconds, then the resulting output signal is supplied to an input terminal of an OR gate 22 whose output terminal is connected to a time counting reset terminal c of the first timer circuit 21. Further details of the first timer circuit 21 will be discussed with reference to FIG. 2. The first timer circuit 21, when receiving a positive pulse from the power on input key 15 via an input terminal d, sets a first flip flop 62 and provides its output for energizing a relay coil 23 and for causing a timer circuit comprising a series connection of a resistor 24 and a capacitor 25 to start charging. In particular, the relay coil 23 is excited by the output of the flip flop 62, thereby causing a contact 31 which is located between a second terminal and a gate terminal of the triac 2 via a resistor 32 to be closed and thereby supplying the frequency converter with the source voltage. When the terminal voltage of the capacitor 25 having already started charging in response to the flip flop 62 exceeds the input threshold voltage of an inverter 26 (as denoted by the dotted lined $e_2$ in FIG. 3), the inverter 26 provides an inverted output to an input terminal of a NOR gate 27. A signal resulting from the output setting keys, on the other hand, is connected to a set terminal of a second flip flop 28 by way of an input terminal c, the reset terminal of the flip flop being connected to output terminals of second and third timer circuits 29 and 30. An output terminal of the NOR gate 27 is connected to a reset terminal of the first flip flop 62 which in turn is placed into its reset state in response to a "H" output from the NOR gate 27.

Operation of the first timer circuit will be described in further detail. A signal resulting from the power on key actuated functions to set the flip flop 62 which in turn supplies a "H" level output to render the triac 2 conductive. The flip flop 62 remains in its set state until the terminal voltage of the capacitor 25 which had starting charging simultaneously reaches the input threshold voltage of the inverter 26. In the event that any output setting signal comes before the output of the inverter 26 is inverted with the charging voltage of the capacitor 25, the second flip flop 28 is not set so that the output of the NOR gate 27 assumes a "H" level so as to place the first flip flop 62 into its reset state at the moment where the output of the inverter 26 assumes a "L" level. As a result, the relay 23 is not excited and the triac 2 returns back to its off state (point X in FIG. 3). On the ther hand, if any output setting signal appears before the inverter 26 inverts its output state and the second flip flop 28 is set, then the output of the NOR gate 27 still assumes the "L" level even after the inverter 26 its output state with the passage of a given period of time T. The result is that the first flip flop 62 is not reset and the triac 2 remains conductive (point Y in FIG. 3). When the user touches the power off key 20 or a fault signal develops from the frequency converter 3, the second flip flop 28 is reset via the input terminal e or f of the first timer circuit 21 and the output of the NOR gate 27 assumes a "L" level to reset the first flip flop 62. The triac 2 therefore returns to its off state and the capacitor 25 starts discharging. All of the components return to their initial state (point Z in FIG. 3).

It is evident from the foregoing description of the structure and operation that the power switch is turned off to assure safety in operation unless any output setting key is actuated within a predetermined period of time subsequent to the actuation of the power on key. In the above illustrated embodiment, the first timer circuit 21 is not prevented from performing a time counting operation even when the fine adjustment down key 19 is touched by the user.

The control circuit 11 operates in the following manner after the first timer circuit 21 is inhibited from time counting. The output of an OR gate 33 which is actuated by the output of the OR gate 22 and the fine adjustment down key 19, combined with a pan-absence signal from a pan detector 34, renders operative an AND gate 35 whose output is connected to the second timer circuit 29. The pan detector is so adapted that a magnet in the appliance is attracted by a magnetic pan mounted therein and such a movement is converted into an electric signal by means of a switch or the like, but it should not be limited thereto. The output of the AND gate 35 activates a first alarm 36 for visually alerting the user and a second alarm 37 for audibly alerting the user. The output of the OR gate 33 and a pan-presence signal from the pan detector are connected to a driver 38 for the frequency converter 3. Where any output level is set and the pan is properly mounted, the thyristor 7 is excited by the output of the driver 38, thereby supplying the high frequency current to the heating coil 10. It is noted that the driver 38 may be implemented by a self-running oscillator such as an astable multivibrator. The frequency converter 3 is therefore excited only when an output level is set and the pan is mounted in place, thus ensuring energy savings. Unless the pan is mounted, the user or one with weak eyes or ears is prompted to install the pan. In addition, the appliance is very safe since the first timer circuit is reset so as to turn off power supply when the situation where the pan is free lasts for a time setting which is set in the second timer circuit 29.

It is generally known in the art of induction heating type cooking appliances that they are provided with an overheating protector for avoiding a dangerous situation or an abnormal temperature rise in the internal components when the pan is heated with no load or an air inlet or outlet port is blocked, a small utensil load detector for preventing such a small-sized utensil such as a knife or a fork from undue heating, a pan centering detector for sensing that the pan is not mounted at the center of a heating section and for minimizing disturbances due to undesirable magnetic radiation and so forth. Those protective devices guarantee that the user may be safe against faulty use of the appliance. In the above illustrated embodiment, a protect circuit 43 is set up by an OR gate enabled with the output of either an overheating detector 39, a small-sized load detector 40 or a pan centering detector 41 and the output of the protect circuit 43 is connected to an input terminal of the driver 38. The driver 38 is disabled when any one of those detector devices finds a faulty condition. The output of the protect circuit 43 renders operative the second timer circuit 29, the first alarm 36 and the second alarm 37, advising the user of such a faulty condition. In other words, when any faulty situation happens in the appliance, the user is immediately advised of such a faulty situation both visually and audibly. When such a faulty situation lasts for a predetermined period of time (say, 5 minutes), the triac 2 is turned off so as to turn off the power supply and secure safety in operation. As soon as the user touches the off key 20, the resultant signal inhibits the driver 38 from operating and allows the third timer circuit 30 to operate. Upon the lapse of a given period of time (29–50 msec) the triac 2 is turned off. This operation is most effective when the power switch includes a relay or the like, and is especially useful in improving reliability by preventing the frequency converter 3 from oscillating when relay contacts are opened or closed and preventing the occurrence of an arc between the contacts. A time setting in the third timer circuit 30, therefore, should be longer than the length of time necessary for the frequency converter 3 to cease oscillating completely in response to a disabling signal from the driver 38. Though the power switch is turned on upon an input to the power on key, the frequency converter has not yet oscillated at this moment because of no output setting. Accordingly, a rush of current through the switch never deteriorates the reliability of the contacts.

Figure 4:
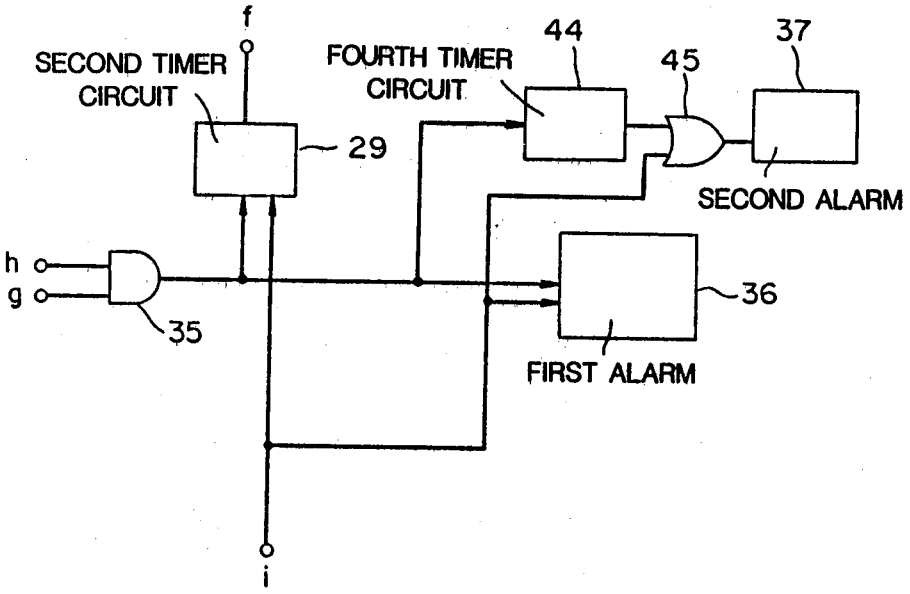
FIG. 4 is a circuit diagram of principal components of the appliance.

Referring to FIG. 4, the outpuf of the AND gate 35, which is responsive to the pan-absence signal g and the output setting signal h activates the second timer circuit 29 and a fourth timer circuit 44 at the same time. When the output of the AND circuit 35 lasts over a time setting in the fourth timer circuit, an OR gate 45 is activated. The OR gate 45 receives as another input the fault detection signal i and activates the second alarm upon receipt of either the output of the fourth timer circuit 44 or the fault detection signal i . A visual alarm and an audible alarm are delivered at the same time under such a faulty situation. Where an output level is set but the pan is not mounted, only a visual alarm is delivered for a given period of time (about 1 minute) and an audible alarm together with the visual alarm are subsequently delivered. It is thus possible to prevent the delivery of an alarm whenever the pan is shifted or moved in the process of cooking, and to avoid undue delivery of an alarm while the appliance is in use. Where the pan is left on the appliance even after a table or the like is removed upon completion of cooking, the user's attention is invited to such a fact. Should the pan be still left, the power supply is shut off. This arrangement eliminates the need to manually turn off the power switch and offers the user a good deal of convenience.

Figure 5:
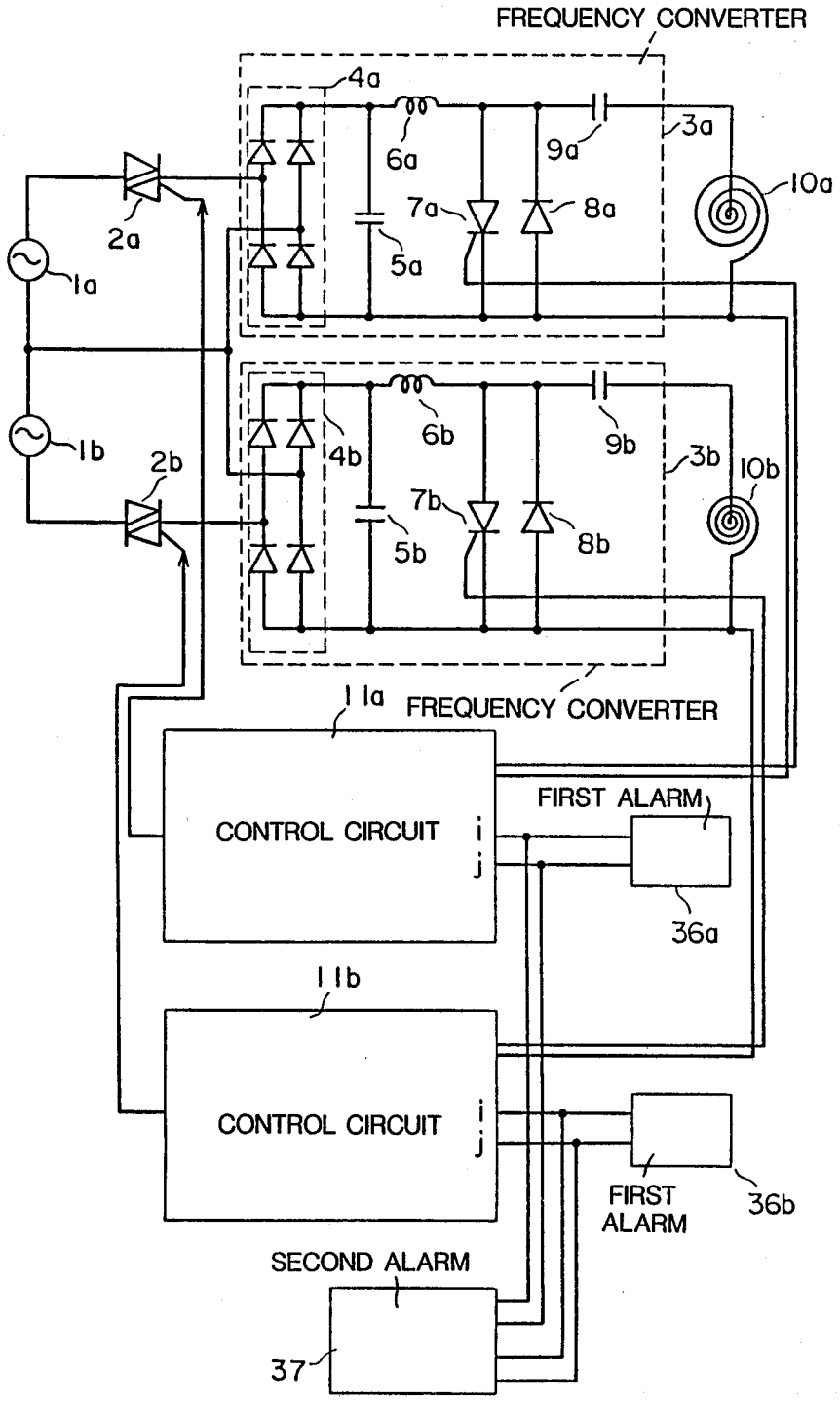
FIG. 5 is a circuit diagram of an induction heating type cooking appliance according to another embodiment of the present invention.

FIG. 5 shows an example of the above suggested arrangement, wherein triacs 2a and 2b, frequency converters 3a and 3b, a high output level heating coil 10a and a low output level heating coil 10b are connected to single-phase threewire power sources 1a and 1b, respectively. Though the high output level and low output level induction heating coils are provided herein, it is obvious that two coils having the same output level may be provided. It is however noted that the appliance with the high and low output levels is more convenient for the user because it may enlarge the scope of cooking. First visual alarms 36a and 36b each for the respective one of the heating coils 10a and 10b are energized individually with a fault detection signal i from a control circuit 11a or 11b for governing operation of the triacs and the frequency converters and a pan-absence signal j , whereas a second audible alarm 37 is energized commonly to the two coils.

The above mentioned effect is very advantageous because the human's sense of direction relying upon his sense of hearing is uncertain and separate alarms provided when faulty situations occur in a plurality of heating sections appear to be noisy. In other words, the user may move close to the induction heating type cooking appliance and check the heating sections (for example, heating with no load or misalignment of the pan) when hearing an alarm sound. Furthermore, provided that he does nothing in the delivery of an alarm sound, the frequency converter including an out-of-order heating coil is disabled and the appliance is guarded against such a faulty situation. This is also the true with induction heating type cooking appliances with three or more heating coils while the foregoing has described the appliance with the two heating sections for the convenience of illustration.

Figure 6:
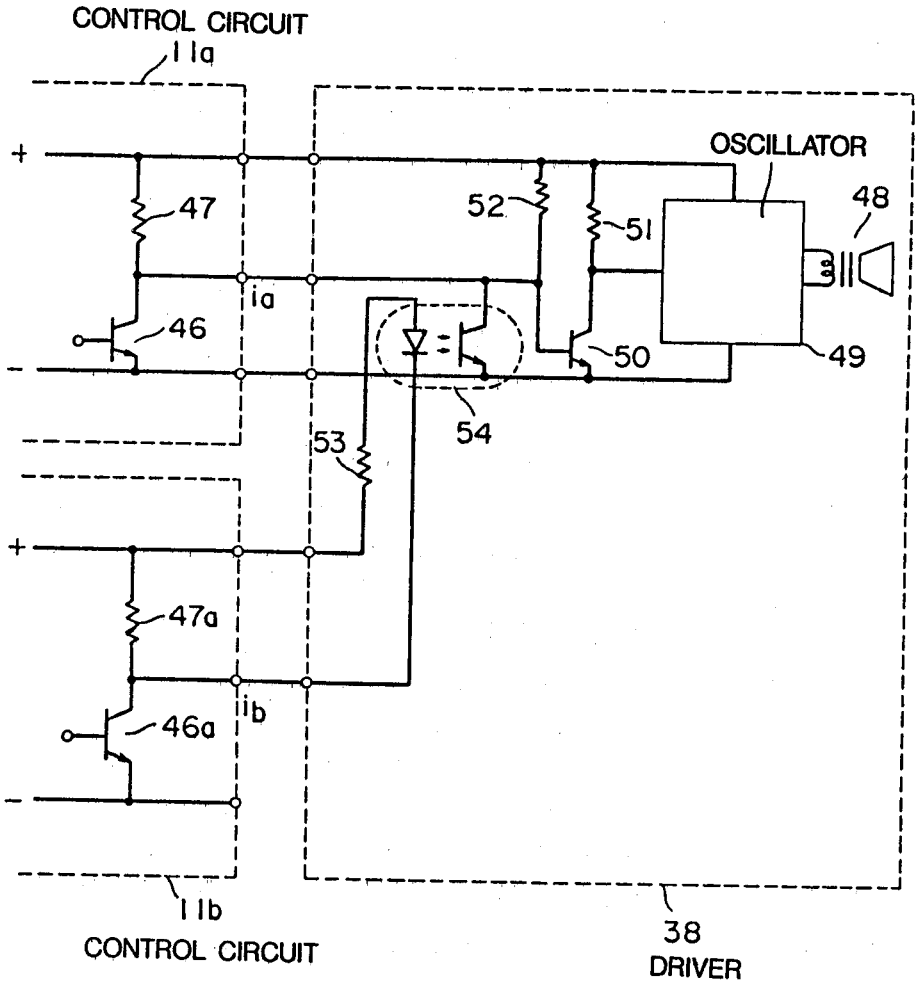
FIG. 6 is a circuit diagram showing details of the embodiment shown in FIG. 5.

FIG. 6 details a structure of the second alarm as shown in FIG. 5. Potentials at the respective frequency converters 3a and 3b are different by a supply voltage of the power source, so that the control circuits 11a and 11b which are connected to the frequency converters 3a and 3b are also different in potential. For this reason it is necessary to evaluate the logic sum of the fault signals from the two control circuits while viewing apart from those potentials. It is further noted that the alarm may be enabled by either of the two power sources. Fault detection outputs ia and ib of the control circuits 11a and 11b are derived from circuits including common emitter NPN transistors 46 and 46a which are conductive in a faulty situation and resistors 47 and 47a which are connected to the collectors of the transistors and a positive voltage terminal and the fault detection outputs ia and ib, namely, the collector voltages of the transistors 46 and 46a and the power source voltages are supplied to the second alarm 38. Whether a sound generator 48 which is enabled with the supply voltage from the control circuit 11a and an oscillator 49 for exciting the sound generator 48 are to operate for the delivery of an alarm sound is dependent upon whether an NPN transistor 50 which is connected to an input terminal of the oscillator 49 is in its on or off position. A resistor 51 is connected between the positive voltage terminal and the collector of the transistor 50 and a resistor 52 is connected between the positive voltage terminal and the base of the transistor 50. A terminal leading to the base of the transistor is connected to the fault output ia. The transistor 50 is in its on position and the sound generator 48 is not energized when the fault output ia is absent and the transistor 46 is in its off position. The driver 38 has a resistor 53 connected in series between the positive voltage terminal of the control circuit 11b and the transistor 46a and an LED of a photo-coupler 54. The LED of the photo-coupler 54 is lit when the control circuit 11b is in its faulty state and the transistor 46a is turned on. The collector and emitter of a phototransistor in the photo-coupler 54 are connected to the base and emitter of the transistor 50 so that the transistor 50 is turned off to allow the sound generator 48 to sound an alarm in response to the fault detection signal ib. It is therefore possible to evaluate the logic sum with isolation while the respective control circuits keep interchangeability under the same specifications.

Figure 7:
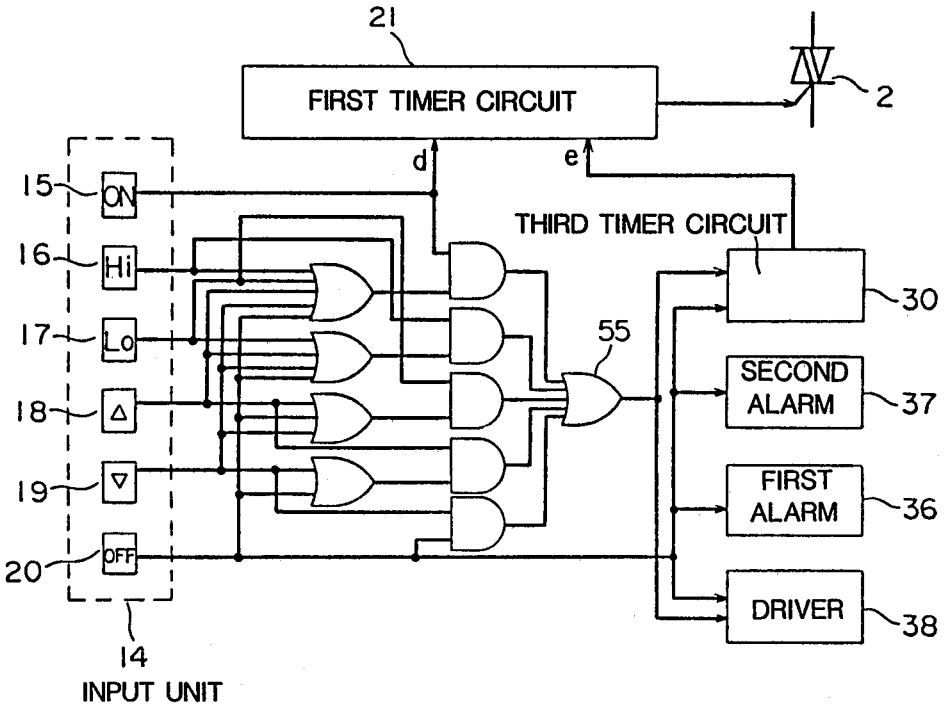
FIG. 7 is a circuit diagram of an induction heating type cooking appliance according to still another embodiment.

In FIG. 7, the same input unit 14 used in FIG. 1 is again used. Of the power on key 15, the plurality of the output level setting keys 16, 17, 18 and 19 and the power off key 20, any one of those keys is connected to an input of an AND gate network and outputs of OR gates connected to the remaining input keys are connected to other inputs of the AND gate network so as to detect that more than one of the input keys have been actuated at the same time. An OR gate 55 is connected to receive the logic sum of the outputs from the AND gate network. The output of the OR gate 55 is connected to a driver 38 which is responsive to the actuation of the power off key 20. The output of OR gate 55 is also connected to an input terminal of the third timer circuit 30, so that the driver 38 is disabled and the frequency converter 3 is prevented from oscillating and the first timer circuit 21 is activated so as to turn off the triac 2 when more than one key of the input unit 14 has been actuated.

Therefore, there is no possibility of increasing the output level or endangering the appliance when the keys are touched accidentally during a long-term simmering process. In addition, the power supply is shut off when electrically conductive water or an electrically conductive material spills or falls on the surface of the input device due to the fact that this is detected as the simulataneous operation of more than one key of the input unit 14. The cooking appliance therefore offers fail-safe features with a high degree of safety.

As described hereinbefore, the present invention provides an induction heating type cooking appliance with the following distinguishing features: safety, cleanliness and efficiency. The appliance includes as an input device touch control keys which are capable of easily controlling operations of circuits when being touched by the user's hand. Furthermore, the input unit is provided with a timer function. It is only when an input key and an output setting key are actuated sequentially that the induction heating type cooking appliance operates. Since the power supply is turned off unless both keys are actuated within a predetermined period of time, it is not possible to turn on the power supply without properly actuating these keys. The power supply is never turned on by childrens' mischief or when the keys are touched accidentally by a pet or the like so that the induction heating type cooking appliance enjoys a high degree of safety. In addition, the timer function is operatively associated with an alarm means which advises the user of misalignment of the pan or no-load heating for the convenience of the user.

We claim:

1. An induction heating type cooking apparatus comprising: a power switch means which is responsive to a control signal; a frequency converter connected to a power source via said switch means; a heating coil which is excited; and a control means for controlling the operation of said frequency converter, said control means including a power on circuit, a pan detecting protective circuit, a fault protective circuit and a power off circuit; said power on circuit including at least three input devices for turning on a power supply, setting an output level and turning off said power supply, wherein said power switch means is supplied with an on signal for a given period of time in response to an output of a first timer circuit becoming operative due to an on input signal and at the same time said first timer circuit is prevented from timing in response to an output setting signal which is introduced within a predetermined period of time when said timer circuit is in operation, wherein a first visual alarm, a second audible alarm and a second timer circuit are rendered operative with the logic product of a pan absence signal from a pan detector included in said pan detecting protective circuit for sensing the presence or absence of a pan to be heated and said output setting signal and the supplying of said power switch on signal to said power on circuit is interrupted by the output of said second timer circuit when said logic product lasts for a predetermined period of time when said second timer circuit is in operation, wherein said fault protective circuit operates said first and second alarms and said second timer circuit in response to a fault output from either of a small-sized load detector, an overheating protective circuit and a pan centering detector and said power switch means is prevented from being actuated when said fault output lasts for more than a time period which has been set in said timer circuit, and wherein said power off circuit inhibits the delivery of said output setting signal and the heating operation of said frequency converter and allows a third timer circuit to operate in response to said power off signal and the output of said power off circuit inhibits the operation of said power switch means.

2. An induction heating type cooking apparatus as set forth in claim 1, further comprising a control for activating said first visual alarm and a fourth timer circuit in response to the logic product of said pan absence signal and the output setting signal and for activating said audible alarm in response to the output of said fourth timer circuit after said logic product lasts for a predetermined period of time.

3. An induction heating type cooking apparatus as set forth in claim 1, wherein there are provided a plurality of heating coils, a same number of controls, and a plurality of first alarms each provided for the respective one of said heating coils and a single second alarm enabled by the logic sum of second alarm enabling signals from the respective controls.

4. An induction heating type cooking apparatus as set forth in claim 1, further comprising a logic product circuit which operates in response to signals from at least three input devices for turning on said power supply, setting an output level and turning off said power supply for inhibiting the delivery of an enabling signal to said power switch means by its logic product output when a plurality of signals are output by said input devices.

* * * * *